US010533578B2

(12) United States Patent
Johnson et al.

(10) Patent No.: US 10,533,578 B2
(45) Date of Patent: Jan. 14, 2020

(54) METAL-TO-METAL SEALING FOR DIFFUSERS OF AN ELECTRICAL SUBMERSIBLE WELL PUMP

(71) Applicant: Baker Hughes Incorporated, Houston, TX (US)

(72) Inventors: Nicholas D. Johnson, Claremore, OK (US); Ryan Semple, Owasso, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 684 days.

(21) Appl. No.: 15/258,930

(22) Filed: Sep. 7, 2016

(65) Prior Publication Data

US 2017/0102009 A1 Apr. 13, 2017

Related U.S. Application Data

(60) Provisional application No. 62/240,067, filed on Oct. 12, 2015.

(51) Int. Cl.
*F04D 13/08* (2006.01)
*F04D 29/62* (2006.01)
(Continued)

(52) U.S. Cl.
CPC ..... *F04D 29/628* (2013.01); *E21B 43/128* (2013.01); *F04D 13/086* (2013.01);
(Continued)

(58) Field of Classification Search
CPC ..... F04D 29/628; F04D 1/063; F04D 13/086; F04D 13/10; F04D 29/086; F04D 29/167;
(Continued)

(56) References Cited

U.S. PATENT DOCUMENTS 1,894,393 A 5/1927 Bigelow
2,001,172 A 5/1935 Wintroath
(Continued)

FOREIGN PATENT DOCUMENTS

WO 2015023636 A1 2/2015
WO WO-2015023636 A1 * 2/2015 ..... F04D 13/10

OTHER PUBLICATIONS

International Search Report and Written Opinion dated Jan. 25, 2017 from corresponding International Application No. PCT/US2016/056468.

*Primary Examiner* — Woody A Lee, Jr.
*Assistant Examiner* — Sabbir Hasan
(74) *Attorney, Agent, or Firm* — Bracewell LLP; James E. Bradley

(57) ABSTRACT

A well pump assembly includes a centrifugal pump having a housing with a cylindrical internal side wall. Upper and lower diffusers are located in the housing. A metal-to-metal seal seals an upper end portion of the lower diffuser to the lower end portion of the upper diffuser. The seal also has an outer surface that frictionally engages the internal side wall of the housing. The seal is energized in response to an axial force exerted between the upper and lower diffusers. One version has a metal seal ring located in mating recesses on the outer walls of the diffusers. Another version includes an inner lip on one of the end portions of the diffusers that extends within and deflects an outer lip on the other of the end portions of the diffusers.

11 Claims, 4 Drawing Sheets

(51) Int. Cl.

| | |
|---|---|
| ***E21B 43/12*** | (2006.01) |
| ***F04D 29/16*** | (2006.01) |
| ***F04D 29/22*** | (2006.01) |
| ***F04D 29/42*** | (2006.01) |

(52) U.S. Cl.
CPC ..... *F04D 29/167* (2013.01); *F04D 29/22* (2013.01); *F04D 29/426* (2013.01); *F04D 29/622* (2013.01)

(58) Field of Classification Search
CPC .... F04D 29/122; F04D 29/426; F04D 29/448; F04D 29/622
See application file for complete search history.

(56) References Cited

U.S. PATENT DOCUMENTS

| | | | | |
|---|---|---|---|---|
| 2,449,772 | A | 9/1948 | Gilman | |
| 4,315,543 | A | 2/1982 | Luers et al. | |
| 4,483,660 | A * | 11/1984 | Roberts | F04D 29/20 156/83 |
| 4,930,996 | A | 6/1990 | Jensen et al. | |
| 6,726,449 | B2 | 4/2004 | James et al. | |
| 8,043,051 | B2 | 10/2011 | Brunner | |
| 8,400,035 | B2 | 3/2013 | Watson | |
| 8,845,308 | B2 | 9/2014 | Tetzlaff et al. | |
| 8,891,076 | B2 * | 11/2014 | Sheth | G01K 11/3206 356/445 |
| 8,894,350 | B2 * | 11/2014 | Brunner | F04D 29/041 415/107 |
| 2013/0259706 | A1 | 10/2013 | Eslinger | |
| 2014/0037434 | A1 | 2/2014 | Eslinger | |
| 2014/0079575 | A1 | 3/2014 | Forsberg | |
| 2015/0132159 | A1 | 5/2015 | Wilson et al. | |
| 2015/0226219 | A1 | 8/2015 | Johnson et al. | |

* cited by examiner

FIG. 3
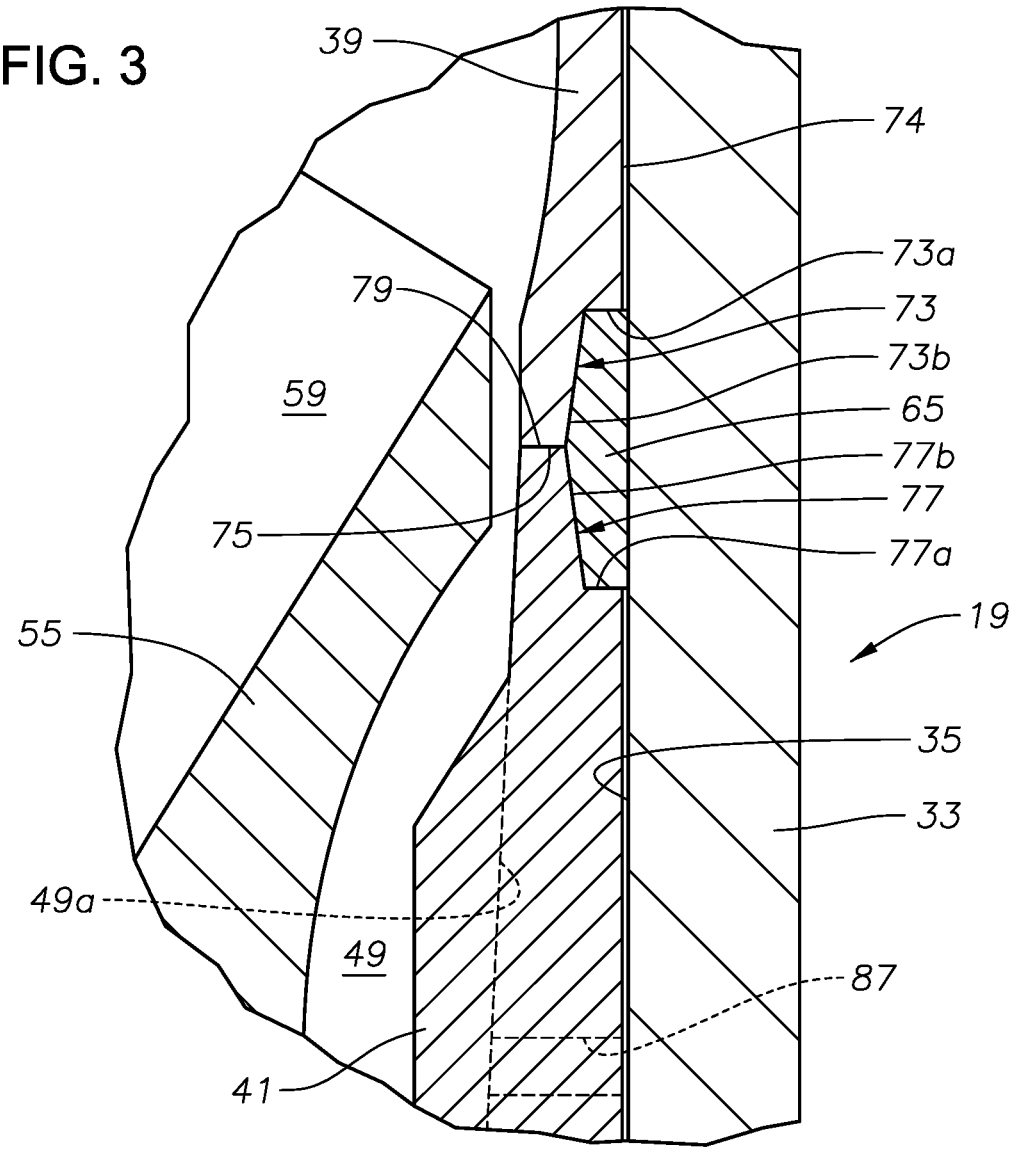
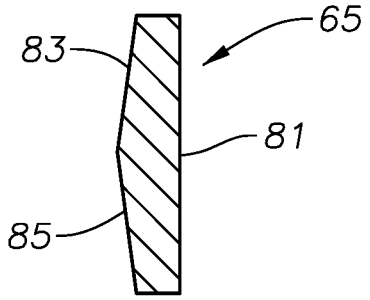
FIG. 4

METAL-TO-METAL SEALING FOR DIFFUSERS OF AN ELECTRICAL SUBMERSIBLE WELL PUMP

1. CROSS REFERENCE TO RELATED APPLICATION

This application claims priority to provisional application 62/240,067, filed Oct. 12, 2015.

2. FIELD OF THE DISCLOSURE

This disclosure relates in general to electrical submersible well pumps and in particular to mechanisms for rotationally locking and sealing diffusers in a centrifugal pump housing.

3. BACKGROUND

One type of submersible well fluid pump has an electrical motor operatively connected with a centrifugal pump. The pump has a large number of stages, each stage having an impeller and a diffuser. A shaft rotated by the motor rotates the impellers relative to the diffusers. Each impeller has passages that lead upward and outward to the next upward diffuser. Each diffuser has diffuser passages that extend upward and inward to the next upward impeller.

The diffusers are stacked together in a housing of the pump. Typically, elastomeric o-ring seals extend around the outer wall of each diffuser and seal against the inner wall surface of the pump housing. Also, the stack of diffusers has an anti-rotation feature to prevent rotation of the diffusers in the housing.

During manufacturing, technicians assemble the impellers and diffusers on the shaft, then push the assembly into the housing. The o-ring seals slide against the inner wall surface of the pump housing during insertion. Providing a larger annular clearance between the outer walls of the diffusers and the inner wall surface of the pump housing facilitates inserting the assembly. However, the larger clearance may compromise the integrity of the o-ring seals.

4. SUMMARY

A well pump assembly, comprises a motor and a centrifugal pump having a housing with a cylindrical internal side wall and a longitudinal axis. An upper and a lower diffuser are located in the housing. Each of the diffusers has a cylindrical outer wall. The lower diffuser has an upper end portion that abuts a lower end portion of the upper diffuser. A central opening extends concentrically through each of the diffusers. A shaft extends rotatably through the central openings in the diffusers. An impeller is mounted to the shaft for rotation therewith and positioned between the diffusers. A metal-to-metal seal seals the upper end portion of the lower diffuser to the lower end portion of the upper diffuser. The seal has an outer surface that frictionally engages the internal side wall of the housing. The seal is energized in response to an axial force exerted between the upper and lower diffusers.

In one embodiment, the metal-to-metal seal comprises an annular lower end recess on the outer wall of the upper diffuser at the lower end portion. An annular upper end recess is formed on the outer wall of the lower diffuser at the upper end portion. The upper end recess and the lower end recess define a seal cavity when the upper end portion abuts the lower end portion. A metal seal ring is located in the seal cavity in sealing engagement with each of the recesses.

In one embodiment, the lower end recess has an outward and downward facing conical surface. The upper end recess has an outward and upward facing conical surface. The metal seal ring has an inward and upward facing conical surface that forms a sealing engagement with the conical surface of the lower end recess. The metal seal ring has an inward and downward facing conical surface that forms a sealing engagement with the conical surface of the upper end recess.

The metal seal ring has a cylindrical outward facing surface with an initial outer diameter less than an inner diameter of the internal side wall of the housing. When energized, the outward facing surface expands outward and forms a sealing engagement with the internal side wall of the housing.

A vent port may extend through the cylindrical outer wall of at least one of the diffusers. More specifically, the lower diffuser has a plurality of diffuser passages leading upward and inward to a central cavity in which the impeller is located. The vent port extends from the outer wall of the lower diffuser into the central cavity.

In another embodiment, the metal-to-metal seal comprises an inner lip on one of the end portions of the diffusers and an outer lip on the other of the end portions of the diffusers. The inner lip extends into the outer lip and deflects the outer lip outward into contact with the internal side wall of the housing while the diffusers are moved axially against each other. The inner lip has an exterior portion with a conical seal surface. An interior portion of the outer lip has a conical seal surface that makes a sealing engagement with the conical seal surface of the inner lip when the seal is energized. The outer lip may have an internal shoulder. The inner lip has an end that abuts the internal shoulder.

5. BRIEF DESCRIPTION OF THE DRAWINGS

FIG. 3 is an enlarged sectional view of a portion of the pump of FIG. 1.

FIG. 4 is a sectional view of the seal ring of FIG. 3 removed from the pump.

Figure 1:
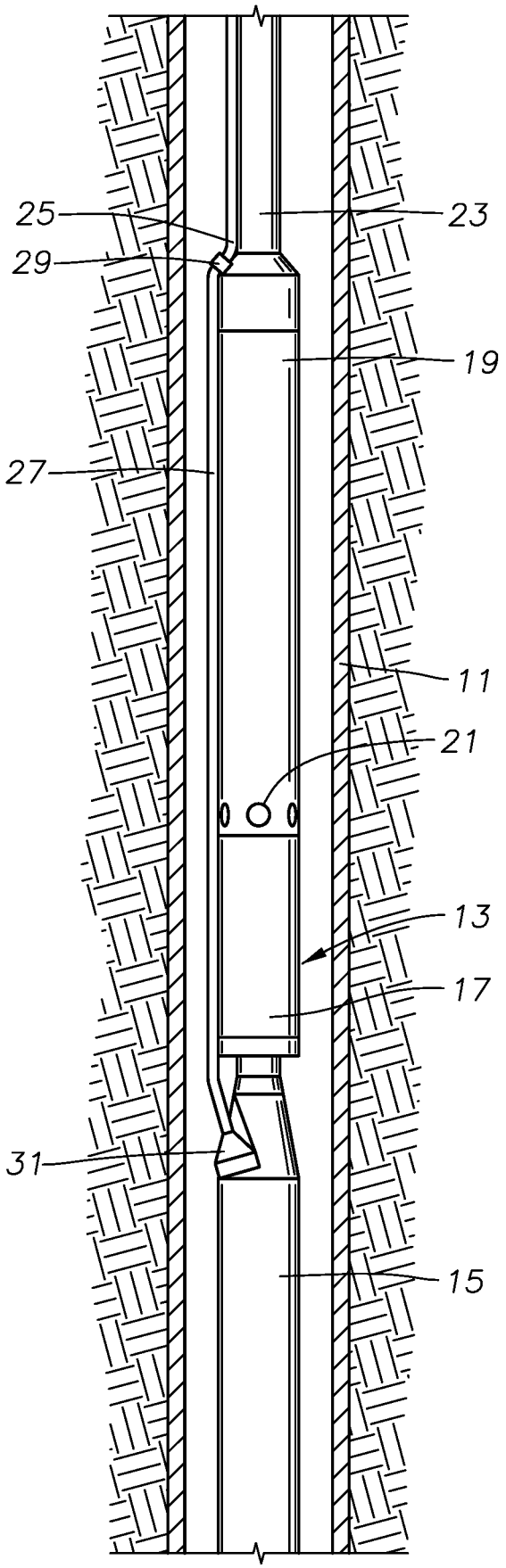
FIG. 1 is a schematic side view of a pump assembly in accordance with this disclosure.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

6. DETAILED DESCRIPTION OF THE DISCLOSURE

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a well with casing 11 is illustrated as containing an electrical submersible pump assembly (ESP) 13. ESP 13 has a motor 15, which is normally a three phase electrical motor. Motor 15 is filled with a dielectric motor lubricant. A pressure equalizer or seal section 17 has features to equalize the internal pressure of the motor lubricant with the hydrostatic pressure of well fluid surrounding motor 15. Seal section 17 may be located above motor 15, as shown, and will be in fluid communication with the motor lubricant in motor 15. Alternately, a pressure equalizer could be located below motor 15. Motor 15 has a drive shaft assembly that extends through seal section 17 and drives a centrifugal pump 19, which has an intake 21 for drawing well fluid in.

A string of production tubing 23 extends to a wellhead (not shown) and supports ESP 13. Tubing 23 may comprise sections secured together by threads. Alternately, tubing 23 may comprise continuous coiled tubing. A power cable 25 extends downward from the wellhead and is strapped to tubing 23. A motor lead 27 connects to power cable 25 at a splice or connection 29 located above ESP 13. Motor lead 27 extends alongside ESP 13 and has a motor lead connector 31 on its lower end that plugs into a receptacle at the upper end of motor 15. Pump 19 discharges well fluid through its upper end into tubing 23 in this example. If tubing 23 is continuous coiled tubing, power cable 25 could be located inside the coiled tubing, in which case, pump 19 would discharge into the annulus in casing 11 surrounding the coiled tubing.

Motor 15, pump 19 and seal section 17 comprise modules that are brought separately to a well site, then secured together by bolted flanges or threaded collars. ESP 13 may have other modules, such as a gas separator and a thrust bearing unit. Alternately, a thrust bearing unit could be formed as part of seal section 17. Also, motor 15, pump 19 and seal section 17 each could be formed in more than one module and connected in tandem.

Figure 2:
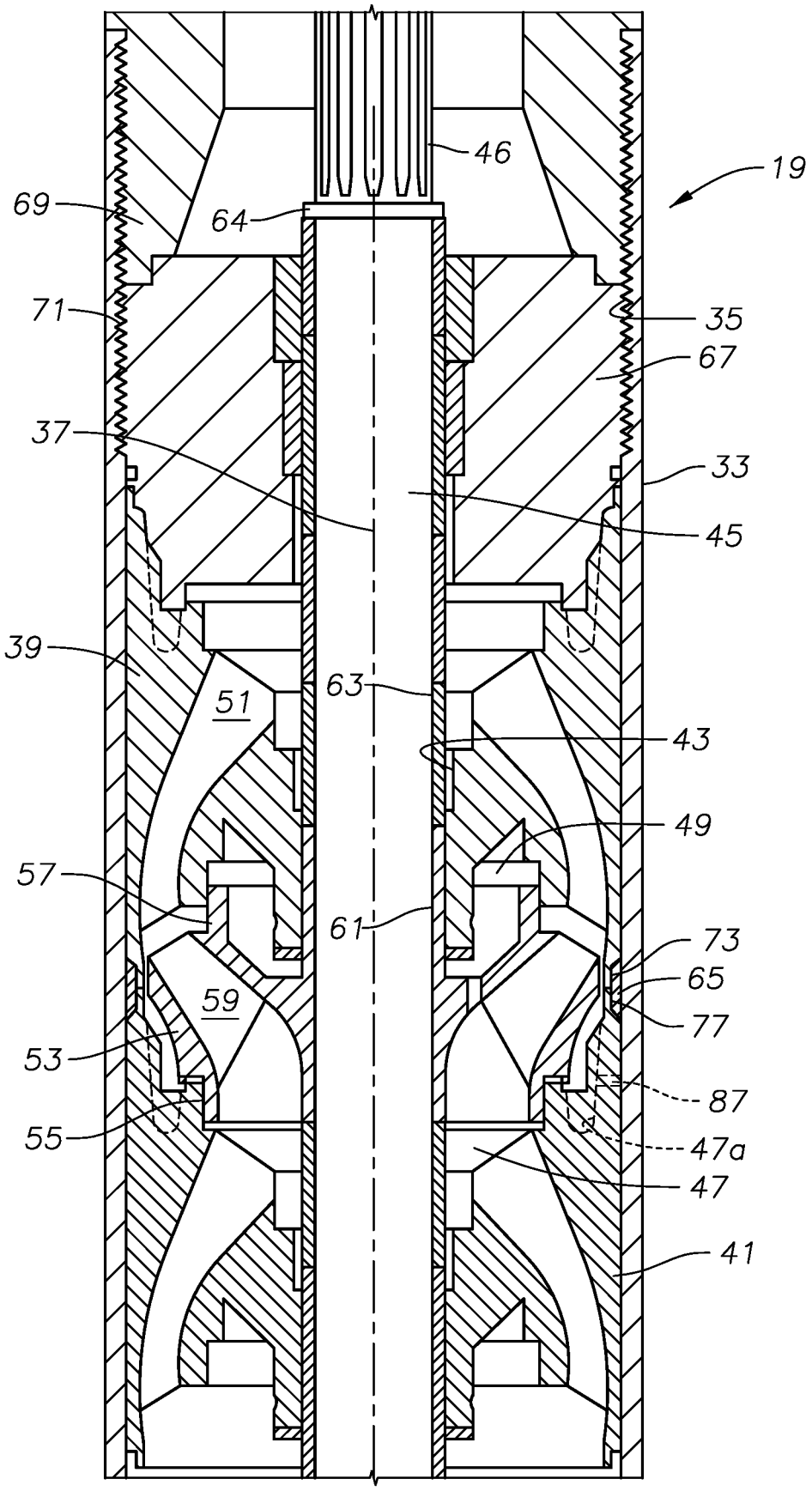
FIG. 2 is a sectional view of an upper portion of the pump of FIG. 1, showing a first embodiment of a mechanism that locks and seals the diffusers in the housing.

FIG. 2 illustrates an upper portion of pump 19. A tubular housing 33 has a cylindrical inner side wall 35 concentric with a longitudinal axis 37. A stack of diffusers 39, 41 (only two shown) fit closely and non rotatably in housing 33. For discussion purposes only, diffuser 39 is considered an upper diffuser and diffuser 41 is considered a lower diffuser. The terms "upper" and "lower" are used only for convenience since pump 19 may operate in a horizontal position. Diffusers 39, 41 may be identical, each having a central coaxial opening 43 through which a rotatable drive shaft 45 extends. Drive shaft 45 may have a splined upper end 46 for connection to another pump (not shown).

Each diffuser 39, 41 has an upper cavity 47 of larger diameter than central opening 43. Upper cavity 47 may have an outer portion 47*a* shown by dotted lines. Each diffuser 39, 41 has a lower cavity 49 that is also of larger diameter than central opening 43. Each diffuser 39, 41 has a plurality of diffuser passages 51 that extend upward and inward from lower cavity 49 to upper cavity 47.

An impeller 53 rotates with shaft 45 and is positioned between diffusers 39, 41. Impeller 53 has a lower cylindrical skirt 55 in sliding and rotating engagement with a cylindrical wall in upper cavity 47 of lower diffuser 41. A cylindrical balance ring 57 on the upper end of impeller 53 locates within lower cavity 49 of upper diffuser 39 in sliding and rotating engagement with a cylindrical surface of lower cavity 49. Impeller passages 59 extend upward and outward from a lower end to an upper end of impeller 53 for receiving well fluid from lower diffuser 41 and discharging the well fluid into upper diffuser 39. Impeller 53 has an impeller hub 61 with a cylindrical bore that receives shaft 45 for rotation therewith, typically by a key and keyway (not shown). One or more spacer sleeves 63 extend upward from impeller hub 61 to a retaining ring 64 at the upper end of shaft 45. Similarly, spacer sleeves 63 extend downward to the next lower impeller (not shown). Impellers 53 are free to move upward and downward a limited distance on shaft 45 between an up thrust position abutting part of upper diffuser 39 and a down thrust position abutting part of lower diffuser 41.

In this disclosure, there are no elastomeric o-rings fitted between diffusers 39, 41 and housing inner side wall 35 as in the prior art. Instead a metal-to-metal seal ring 65 seals end portions of diffusers 39, 41 to each other and also to housing inner side wall 35.

A bearing member 67 fits within housing 33 on top of upper diffuser 39. Bearing member 67 radially supports shaft 45 and is secured within housing 33 by threads 71. Bearing member 67 also serves as a compression device to apply and retain the stack of diffusers 39, 41 in axial compression. Pump 19 has a head 69 on its upper end that also secures in housing 33 with threads and serves to connect pump 19 to other components. Tightening bearing member 67 to threads 71 applies a downward force to upper diffuser 39, lower diffuser 41, and the remaining diffusers in the stack. The compressive force passes from the stack of diffusers 39, 41 into a lower connector, such as the sub for intake 21 (FIG. 1), and back into housing 33. The downward compressive force energizes and sets seal ring 65.

Referring to FIG. 3, in this embodiment, each diffuser 39, 41 has an annular lower end recess 73 formed in an outer cylindrical surface 74 of each diffuser 39, 41. Lower end recess 73 is open to the outer cylindrical surfaces 74 of diffusers 39, 41. A downward facing shoulder 73*a* defines the upper end of lower end recess 73. Shoulder 73*a* may be flat and in a plane perpendicular to axis 37 (FIG. 2). A downward and outward facing conical surface 73*b* extends downward from shoulder 73*a* and defines a remaining portion of lower end recess 73. Conical surface 73*b* extends to a flat lower end 75 of each diffuser 39, 41. Lower end 75 may also be in a plane perpendicular to axis 37 (FIG. 2). Lower end 75 has a radial width about the same as the radial dimension of the lower end of recess 73, but that could differ.

Each diffuser 39, 41 has an annular upper end recess 77 that may have the same dimensions as lower end recess 73. Upper end recess 77 is also open to the outer cylindrical surfaces 74 of diffusers 39, 41. An upward facing shoulder 77*a* defines the lower end of upper end recess 77. Shoulder 77*a* may be flat and in a plane perpendicular to axis 37 (FIG. 2). An upward and outward facing conical surface 77*b* extends upward from shoulder 77*a* and defines a remaining portion of upper end recess 77. Conical surface 77*b* extends upward to a flat upper end 79 of each diffuser 39, 41. Upper end 79 may also be in a plane perpendicular to axis 37 (FIG. 2). Upper end 79 has a radial width about the same as the radial dimension of the upper end of recess 77, but that could differ. The angles of conical surfaces 73*b* and 77*b* relative to axis 37 (FIG. 2) may be the same. The angles can vary and are shown to be about 7 to 10 degrees relative to axis 37.

Metal-to-metal seal ring 65 fits in an interference fit inside the cavity defined by the mating recesses 73, 77. Referring to FIG. 4, seal ring 65 has an outward facing cylindrical wall 81, an inward and upward facing conical surface 83 and an inward and downward facing conical surface 85. The angles of conical surfaces 83, 85 may be the same or slightly different from conical surfaces 73*b*, 77*b*. The axial height of seal ring 65 from its upper end to its lower end is substantially the same or slightly less than the distance from recess shoulder 73*a* to recess shoulder 77*a*.

Seal ring 65 is preferably formed of a softer metal than the metals of diffusers 39, 41 and housing 33. Diffusers 39, 41 are typically formed of a nickel alloy metal called "Ni-Resist" or a nickel aluminum bronze. The material of housing 33 is typically a carbon steel. For example, seal ring 65 may be formed of aluminum or bronze.

Referring again to FIG. 3, an optional vent port 87 may be drilled in each diffuser 39, 41. Vent port 87 extends radially from diffuser outer cylindrical surface 74 inward into upper cavity outer portion 47*a* in this embodiment. Vent port 87 will allow any fluid pressure in the clearance between diffuser outer cylindrical walls 74 and housing inner side wall 35 between metal seals 65 to equalize with the fluid pressure in diffuser upper cavity outer portion 47*a*. The fluid pressure in upper cavity 47*a* will be substantially the same as in upper cavity 47 because impeller skirt 55 (FIG. 1) does not form a seal with the cylindrical portion of upper cavity 47 that it engages. Alternately, the vent port could be located near the lower end of upper diffuser 39 instead of near the upper end of lower diffuser 41. A vent port is not shown in upper diffuser 39 because it is shown engaging bearing 67, not an adjacent diffuser above it.

When diffusers 39, 41 are being installed in housing 33, they will be pushed in from one of the open ends of housing 33 and stacked together. Seal ring 65 will be placed in recesses 73, 77 initially in an un-deformed initial position. Initially, a gap will be present between diffuser upper and lower ends 79, 75, and gaps will be present between the ends of seal ring 65 and recess shoulders 73*a*, 77*a*. Initially, seal ring outward facing wall 81 will have a diameter approximately flush or less with diffuser outer cylindrical surfaces 74, which is slightly less than the inner diameter of housing inner side wall 35.

Once the stack of diffusers 39, 41 is installed and in abutment with a connector or retainer (not shown) at the opposite end, a technician inserts bearing member 67 and tightens bearing member 67 to threads 71 to apply a compressive force to the stack of diffusers 39, 41. Recess conical surfaces 73*b*, 77*b* will slide against seal ring conical surfaces 83, 85, forming a metal-to-metal seal. A component of the compressive force also expands the seal ring outer cylindrical wall 81 outward into metal-to-metal sealing engagement with housing inner side wall 35. When the desired axial compression has been achieved, diffuser ends 75, 79 preferably abut each other. Also, recess ends 73*a*, 77*a* may be abutting or nearly abutting the opposite ends of seal ring 65. The frictional, sealing engagement of seal ring outer wall 81 with housing inner side wall 35 also prevents diffusers 39, 41 from rotating within housing 33. Additional anti-rotation devices are not required. The deformation of seal ring 65 from the initial into the set position may be elastic or it may be permanent.

Figure 5:
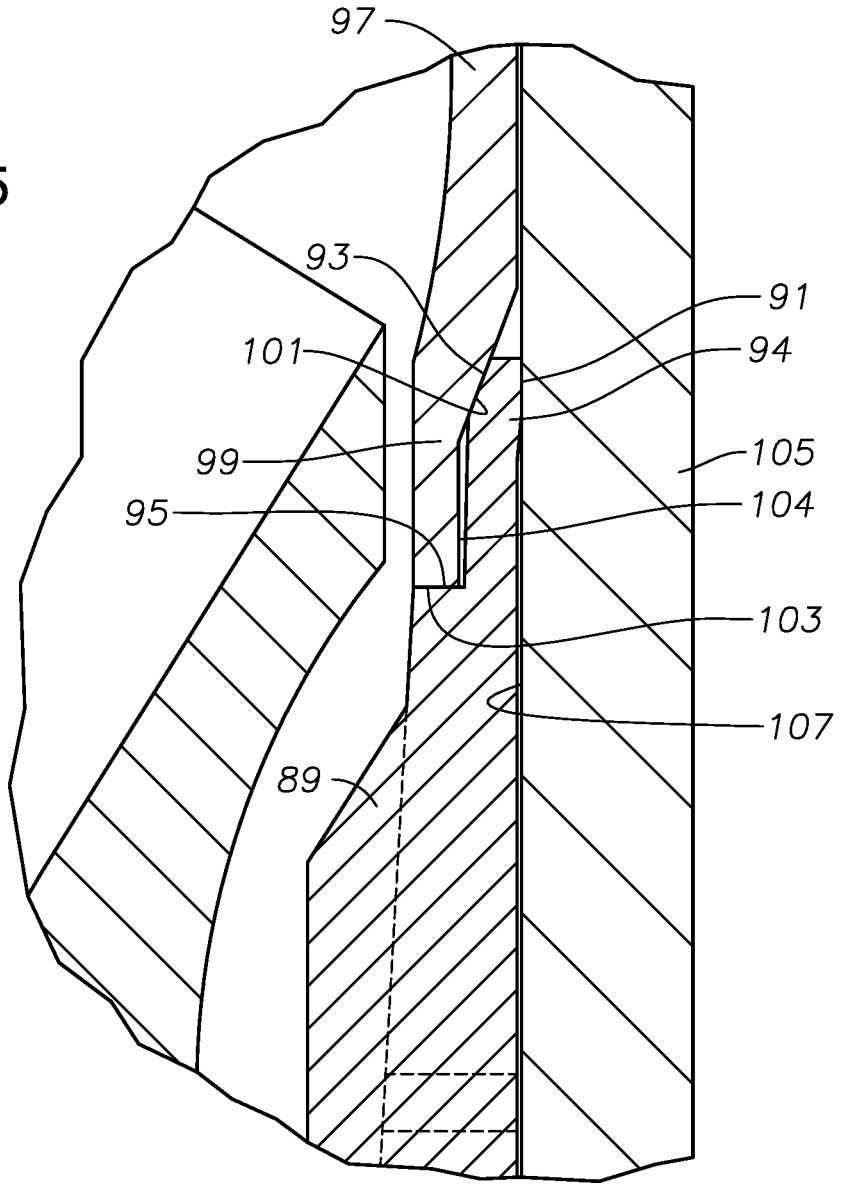
FIG. 5 is an enlarged sectional view of an alternate embodiment of a mechanism that locks and seals the diffusers in the housing.

Referring to FIG. 5, this embodiment does not employ a separate seal ring 65, rather the metal-to-metal sealing portions are integral with the mating diffuser ends. Lower diffuser 89 has on its upper end a lip 91 that is illustrated as being an outer lip. Outer lip 91 is an integral upper end portion of lower diffuser 89. Outer lip 91 has a conical inward and upward facing seal surface 93 on its inner side and an outward facing seal surface 94 on its outer side. Inward facing seal surface 93 and outward facing seal surface 94 extend substantially to the upper end of outer lip 91. Outer lip 91 is radially deflectable from an initial position (not shown) to the sealing position shown in FIG. 5. In the initial position, the outer diameter of outward facing seal surface 94 is substantially equal to the outer diameter of the portion of diffuser 89 below outer lip 91.

An upward facing internal shoulder 95 extends inward from the base of outer lip 91 to an inner diameter portion of lower diffuser 89. In this example, shoulder 95 is flat and perpendicular to the axis of diffuser 89. Shoulder 95 may have a radial width slightly greater than a radial thickness of outer lip 91 at its base.

Upper diffuser 97 has a lip 99 that is an inner lip in this example. Inner lip 99 and outer lip 91 could be reversed, with outer lip 91 being on the lower end of upper diffuser 97. Inner lip 99 is an integrally formed lower end portion of upper diffuser 97. Inner lip 99 has a downward and outward facing conical seal surface 101 formed on its outer side that has a taper matching the taper of outer lip seal surface 93. Inner lip 99 has a lower end 103 that abuts shoulder 95 when diffusers 89, 97 are axially compressed against each other. Inner lip 99 has a cylindrical portion 104 extending upward from lower end 103 to conical seal surface 101. The outer diameter of inner lip cylindrical portion 104 may be less than the inner diameter of outer lip 91 from shoulder 95 to conical seal surface 93, creating an annular clearance. Inner lip 99 may have a greater radial thickness than outer lip 91.

During installation, a stack of diffusers 89, 97 will be pushed into housing 105. A slight clearance initially exists between the outer diameters of diffusers 89, 97 and housing inner side wall 107. An annular clearance will initially exist between outer seal surface 94 of outer lip 91 and housing inner side wall 107. A gap will initially be present between lower end 103 and shoulder 95. When axial compression is applied by tightening bearing member 67 (FIG. 2), seal surface 101 of inner lip 99 will slide downward on inner seal surface 93 of outer lip 91, causing outer lip 91 to deflect radially outward. Outer lip outer seal surface 94 will frictionally engage housing inner side wall 107 to form a metal-to-metal seal as well as prevent rotation of diffusers 89, 97. Conical seal surfaces 93, 101 also form a metal-to-metal seal. When the desired axial compression is reached, lower end 103 will abut shoulder 95. The deflection of outer lip 91 is preferably elastic, but it could be permanent. In this embodiment, inner lip 99 does not deflect while undergoing axial compression.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. A well pump assembly, comprising:

a motor;

a centrifugal pump having a housing with a cylindrical internal side wall and a longitudinal axis;

an upper and a lower diffuser in the housing, each of the diffusers having a cylindrical outer wall;

a central opening extending concentrically through each of the diffusers;

a shaft extending rotatably through the central openings in the diffusers;

an impeller mounted to the shaft for rotation therewith and positioned between the diffusers;

an annular lower end recess on a lower end portion of the outer wall of the upper diffuser, the lower end recess having an outward and downward facing conical surface;

an annular upper end recess on an upper end portion of the outer wall of the lower diffuser, the upper end recess having an outward and upward facing conical surface;

a metal seal ring having an inward and upward facing conical surface and an inward and downward facing conical surface;

the seal ring being configured to have an initial position with an outer surface on the seal ring having an initial outer diameter initially less than an inner diameter of the internal side wall of the housing and a set position with a set outer diameter greater than the initial outer diameter; and a compression device being configured to apply a compressive axial force on the diffusers that deforms the seal ring from the initial position to the set position, causing the conical surfaces of the seal ring to sealingly engage the conical surfaces of the recesses, and causing the outer surface of the seal ring to sealingly engage the internal side wall of the housing.

2. The assembly according to claim 1, wherein the outer surface of the seal ring is cylindrical.

3. The assembly according to claim 1, wherein the outer surface of the seal ring while in the initial position has an outer diameter no greater than an outer diameter of the outer walls of the diffusers.

4. The assembly according to claim 1, wherein:

the diffusers and the housing are formed of metals; and the seal ring is formed of a softer metal than the metals of the diffusers and the housing.

5. The assembly according to claim 1, further comprising:

a vent port extending through the cylindrical outer wall of at least one of the diffusers.

6. The assembly according to claim 1, wherein:

the lower diffuser has a plurality of diffuser passages leading upward and inward to a central cavity in which the impeller is located; and the assembly further comprises:

a vent port extending from the outer wall of the lower diffuser into the central cavity below the seal ring.

7. A well pump assembly, comprising:

a motor;

a centrifugal pump having a housing with a cylindrical internal side wall and a longitudinal axis;

an upper and a lower diffuser in the housing, each of the diffusers having a cylindrical outer wall, the upper diffuser having a lower end portion, and the lower diffuser having an upper end portion; a central opening extending concentrically through each of the diffusers;

a shaft extending rotatably through the central openings in the diffusers;

an impeller mounted to the shaft for rotation therewith and positioned between the diffusers;

an inner lip on one of the end portions of the diffusers, the inner lip having an exterior conical seal surface;

an outer lip on the other of the end portions, the outer lip having an interior conical seal surface, the outer lip being configured to have an initial position with an outer surface having an initial outer diameter initially less than an inner diameter of the internal side wall of the housing and a set position with a set outer diameter of the outer surface of the outer lip greater than the initial outer diameter; and a compression device being configured to apply a compressive axial force on the diffusers and on the inner lip to cause the inner lip to deform the outer lip from the initial position to the set position, causing the conical surfaces of the inner and outer lips to sealingly engage each other, and causing the outer surface of the lower diffuser to sealingly engage the internal side wall of the housing.

8. The assembly according to claim 7, wherein the initial outer diameter of the outer lip does not exceed an outer diameter of the outer walls of the diffusers.

9. The assembly according to claim 7, wherein:

the lower diffuser has a plurality of diffuser passages leading upward and inward to a central cavity in which the impeller is located; and the assembly further comprises:

a vent port extending from the outer wall of the lower diffuser into the central cavity below the inner and outer lips.

10. The assembly according to claim 7, wherein the inner lip remains free of deformation while the compression device moves the outer lip from the initial to the set position.

11. The assembly according to claim 7, wherein a radial thickness of the inner lip is greater than a radial thickness of the outer lip.

* * * * *